US010875674B2

(12) United States Patent
Yokota et al.

(10) Patent No.: US 10,875,674 B2
(45) Date of Patent: Dec. 29, 2020

(54) PUSH-IN MECHANISM AND BOX PACKING DEVICE PROVIDED WITH SAME

(71) Applicant: ISHIDA CO., LTD., Kyoto (JP)

(72) Inventors: Yuji Yokota, Ritto (JP); Atsushi Takahashi, Ritto (JP); Takeshi Noguchi, Ritto (JP); Tatsuya Iwasa, Ritto (JP); Tatsuya Arimatsu, Ritto (JP); Hiroshi Okano, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 280 days.

(21) Appl. No.: 15/541,530

(22) PCT Filed: Oct. 9, 2015

(86) PCT No.: PCT/JP2015/078703
§ 371 (c)(1),
(2) Date: Jul. 5, 2017

(87) PCT Pub. No.: WO2016/117178
PCT Pub. Date: Jul. 28, 2016

(65) Prior Publication Data

US 2018/0016043 A1 Jan. 18, 2018

(30) Foreign Application Priority Data

Jan. 23, 2015 (JP) ..... 2015-010896

(51) Int. Cl.
*B65B 35/40* (2006.01)
*B65B 5/06* (2006.01)
*B65B 5/10* (2006.01)

(52) U.S. Cl.
CPC ..... *B65B 35/405* (2013.01); *B65B 5/06* (2013.01); *B65B 5/106* (2013.01)

(58) Field of Classification Search
CPC ..... B65B 35/40; B65B 35/405; B65B 5/069; B65B 5/06; B65B 5/068; B65B 5/106; B65B 5/04; B65B 43/54
(Continued)

(56) References Cited

U.S. PATENT DOCUMENTS 2,024,503 A * 12/1935 Bickford ..... B65B 5/06 53/536
2,651,442 A * 9/1953 Malhiot ..... B65B 35/405 53/252

(Continued)

FOREIGN PATENT DOCUMENTS

DE 102004050197 A1 4/2006
EP 1329384 A1 7/2003

(Continued)

OTHER PUBLICATIONS

Translation of the Written Opinion of the International Searching Authority, dated Jul. 25, 2017.

(Continued)

*Primary Examiner* — Robert F Long
*Assistant Examiner* — Eduardo R Ferrero
(74) *Attorney, Agent, or Firm* — Global IP Counselors, LLP

(57) ABSTRACT

A push-in mechanism pushes articles into a box that is opened sideways. The push-in mechanism is provided with a box standby part, an article placement part, a push-in plate, a horizontal movement mechanism, and a lifting/lowering mechanism. The box standby part causes the boxes to wait. The article placement part has a placement surface on which the articles are temporarily placed. The push-in plate is installed in a standing state so as to have a pressing surface for pressing the articles toward the box. The horizontal movement mechanism causes the push-in plate to recipro- (Continued)

cate horizontally above the placement surface so that the push-in plate moves toward the box or moves away from the box. The lifting/lowering mechanism moves the push-in plate so as to change a separation distance in the height direction between a lower edge of the pressing surface and the placement surface.

8 Claims, 14 Drawing Sheets

(58) Field of Classification Search
USPC ..... 53/566, 25
See application file for complete search history.

(56) References Cited

U.S. PATENT DOCUMENTS 2,857,721 A * 10/1958 Edgar ..... B65B 5/06 53/448
2,972,842 A * 2/1961 Hitchcock ..... B65B 5/06 53/55
2,985,321 A * 5/1961 Amenta ..... B65B 35/40 198/429
3,039,248 A * 6/1962 Wickliffe ..... B65B 5/06 53/152
3,041,803 A 7/1962 Gamberini
3,220,158 A * 11/1965 Roser ..... B65B 5/06 53/535
3,269,091 A * 8/1966 Martin ..... B65B 63/022 53/252
3,363,394 A * 1/1968 Rainbow ..... B65B 35/40 53/496
3,410,049 A 11/1968 Steenberg et al.
3,516,220 A * 6/1970 Buford ..... B65B 3/28 53/502
3,533,207 A * 10/1970 Jones ..... B65B 11/54 53/462
3,735,561 A * 5/1973 Wood ..... B65B 5/08 53/245
3,914,921 A * 10/1975 Doran ..... B65B 35/40 53/543
4,261,159 A * 4/1981 Aiuola ..... B65B 5/04 53/258
6,397,567 B1 * 6/2002 Focke ..... B65B 5/06 414/790.3
7,073,310 B1 * 7/2006 Long ..... B65B 25/145 53/117
7,721,509 B2 * 5/2010 Vissers ..... B65B 5/06 53/252
2003/0163974 A1 * 9/2003 Pike ..... B65B 5/04 53/252
2007/0240381 A1 * 10/2007 Alfonso ..... B65B 21/20 53/251
2009/0269173 A1 * 10/2009 De Leo ..... B65B 5/06 414/288
2009/0277133 A1 * 11/2009 Yokota ..... B65B 35/58 53/244
2009/0290961 A1 * 11/2009 Langston ..... B65B 5/04 414/222.01
2009/0301037 A1 * 12/2009 Franzaroli ..... B65B 9/073 53/461
2010/0170196 A1 * 7/2010 Iwasa ..... B65G 47/647 53/391
2011/0011035 A1 * 1/2011 Praestholm ..... B30B 9/3014 53/438
2011/0036055 A1 * 2/2011 Shibagaki ..... B65B 5/067 53/266.1
2012/0006651 A1 1/2012 Cote
2013/0243558 A1 9/2013 Beer et al.
2014/0083062 A1 * 3/2014 Arimatsu ..... B65B 5/024 53/564
2015/0274338 A1 * 10/2015 Kawano ..... B65B 35/205 53/556

FOREIGN PATENT DOCUMENTS

JP 06-056107 A 3/1994
JP 2010-155648 A 7/2010
JP 2011-219123 A 11/2011
WO 2012-165632 A1 12/2012
WO WO-2013121550 A1 * 8/2013 ..... B65B 43/39

OTHER PUBLICATIONS

An Extended Search Report of the corresponding European Patent Application No. 15878867.9, dated Jun. 7, 2018.

* cited by examiner

PUSH-IN MECHANISM AND BOX PACKING DEVICE PROVIDED WITH SAME

CROSS-REFERENCE TO RELATED APPLICATIONS

This U.S. National stage application of PCT/JP2015/078703 claims priority under 35 U.S.C. § 119(a) to Japanese Patent Application No. 2015-010896, filed in Japan on Jan. 23, 2015, the entire contents of which are hereby incorporated herein by reference.

TECHNICAL FIELD

The present invention relates to a push-in mechanism and a box packing device provided with the same.

BACKGROUND ART

Box packing devices are often used for packing a plurality of wrapped articles automatically in cardboard boxes for the purpose of shipment in factories that produce products wrapped in film bags. Japanese Laid-Open Patent Publication No. 2010-155648 discloses one example of such a box packing device.

Most box packing devices are functionally divided into a feed mechanism, an accumulating mechanism, and a push-in mechanism. The feed mechanism feeds wrapped articles one at a time. The accumulating mechanism accumulates a predetermined number of wrapped articles among the wrapped articles supplied by the feed mechanism. The push-in mechanism pushes the group of accumulated wrapped articles into a cardboard box. The push-in action is repeated a predetermined number of times for one cardboard box.

SUMMARY OF THE INVENTION

Technical Problem

If the action for pushing in the group of wrapped articles into the cardboard box by the push-in mechanism is slow, this push-in action becomes a bottleneck in the production line. Even if the processing capabilities of the feed mechanism and the accumulating mechanism, for example, are fast, the mechanisms must temporarily stop operating in order to wait for the preparation of the push-in action to be completed. As a result, the efficiency of the overall production line falls.

An object of the present invention is to increase the speed of the push-in action and improve the efficiency of the production line.

Solution to Problem

A push-in mechanism according to a first aspect of the present invention pushes articles into a box that is opened sideways. The push-in mechanism is provided with a box standby part, an article placement part, a push-in plate, a horizontal movement mechanism, and a lifting/lowering mechanism. The box standby part causes the box to wait. The article placement part has a placement surface on which the articles are temporarily placed. The push-in plate is installed in a standing state so as to have a pressing surface for pushing the articles toward the box. The horizontal movement mechanism reciprocates the push-in plate horizontally over the placement surface so that the push-in plate moves toward the box or moves away from the box. The lifting/lowering mechanism moves the push-in plate so as to change a separation distance in the vertical direction between a lower edge of the pressing surface and the placement surface.

According to this configuration, the height of the lower edge of the pressing surface can be changed. Therefore, after the push-in action of the push-in plate pushing the article into the box is finished, hindering of the movement of the next article to be pushed into the box can be suppressed by increasing the height of the lower edge of the pressing surface.

The push-in mechanism according to a second aspect of the present invention is related to the push-in mechanism according to the first aspect, wherein the push-in plate has a first plate and a second plate. The first plate is installed in a standing state. The second plate is installed in a standing state closer to the placement surface than the first plate. The second plate has the pressing surface described in the first aspect. The lifting/lowering mechanism moves the second plate in the vertical direction to change the separation distance.

According to this configuration, the dimension in the vertical direction of the push-in plate is extended and shrunk by the movement of the second plate. Therefore, the push-in mechanism conforms to articles of varying sizes.

The push-in mechanism according to a third aspect of the present invention is related to the push-in mechanism according to the first aspect or the second aspect, wherein the lifting/lowering mechanism sets the separation distance to a first distance when the horizontal movement mechanism moves the push-in plate toward the box. The lifting/lowering mechanism sets the separation distance to a second distance when the horizontal movement mechanism moves the push-in plate away from the box. The second distance is greater than the first distance.

According to this configuration, the height of the lower edge of the pressing surface increases during the return action of the push-in plate. Therefore, the next article to be pushed into the box can be moved during the return action of the push-in plate and, consequently, the speed of the push-in action can be increased.

The push-in mechanism according to a fourth aspect of the present invention is related to the push-in mechanism according to the first aspect or the second aspect, wherein the lifting/lowering mechanism sets the separation distance to a first distance when the horizontal movement mechanism moves the push-in plate toward the box. The lifting/lowering mechanism sets the separation distance to a second distance when the horizontal movement mechanism moves the push-in plate away from the box. The second distance is greater than the first distance when the size of the article is smaller than a predetermined size. The second distance is equal to the first distance when the size of the article is greater than the predetermined size.

According to this configuration, an article having a greater height can be packed into the box in a stable manner due to the second plate as well as the first plate being involved in the pushing action.

The push-in mechanism according to a fifth aspect of the present invention is related to the push-in mechanism described in any one of the first aspect to fourth aspect, wherein the push-in plate is capable of extending and retracting in the width direction. The width direction is perpendicular to both a reciprocating direction and the vertical direction of the push-in plates.

According to this configuration, the width of the push-in plate can be increased when handling a large product wrapped in a bag, for example. Therefore, the push-in action of an article that is larger than a predetermined size can be carried out in a stable manner.

A box packing device according to a sixth aspect of the present invention comprises a feed mechanism, an accumulating mechanism, and the push-in mechanism. The feed mechanism feeds the articles in order one at a time. The accumulating mechanism accumulates a predetermined number of the articles. The push-in mechanism pushes a predetermined number of the articles into a box. The push-in mechanism is related to any one of the first to fifth aspects.

According to this configuration, the box packing device is provided with a push-in mechanism having a fast processing speed. Therefore, the processing speed of the box packing device can be improved.

The box packing device according to a seventh aspect of the present invention is related to the box packing device according to the sixth aspect, wherein the accumulating mechanism has a first conveyor belt, a second conveyor belt, and a third conveyor belt. The first conveyor belt receives articles from the feed mechanism. The first conveyor belt is disposed in an inclined manner. The second conveyor belt forms an article group including the predetermined number of the articles. The third conveyor belt receives the article group from the second conveyor belt and is capable of temporarily holding the article group. The article placement mechanism has a placement conveyor belt. The placement conveyor belt receives the article group from the third conveyor belt and moves the article group to the placement surface.

According to this configuration, the third conveyor belt of the accumulating mechanism functions as a buffer. Therefore, the accumulating mechanism can be prevented from becoming a bottleneck in the production line.

Effects of Invention

According to the push-in mechanism as in the present invention, hindering of the movement of the articles can be suppressed. The processing speed of the box packing device in which the push-in mechanism is mounted is faster.

DESCRIPTION OF EMBODIMENTS

First Embodiment

Overall Configuration

Figure 1:
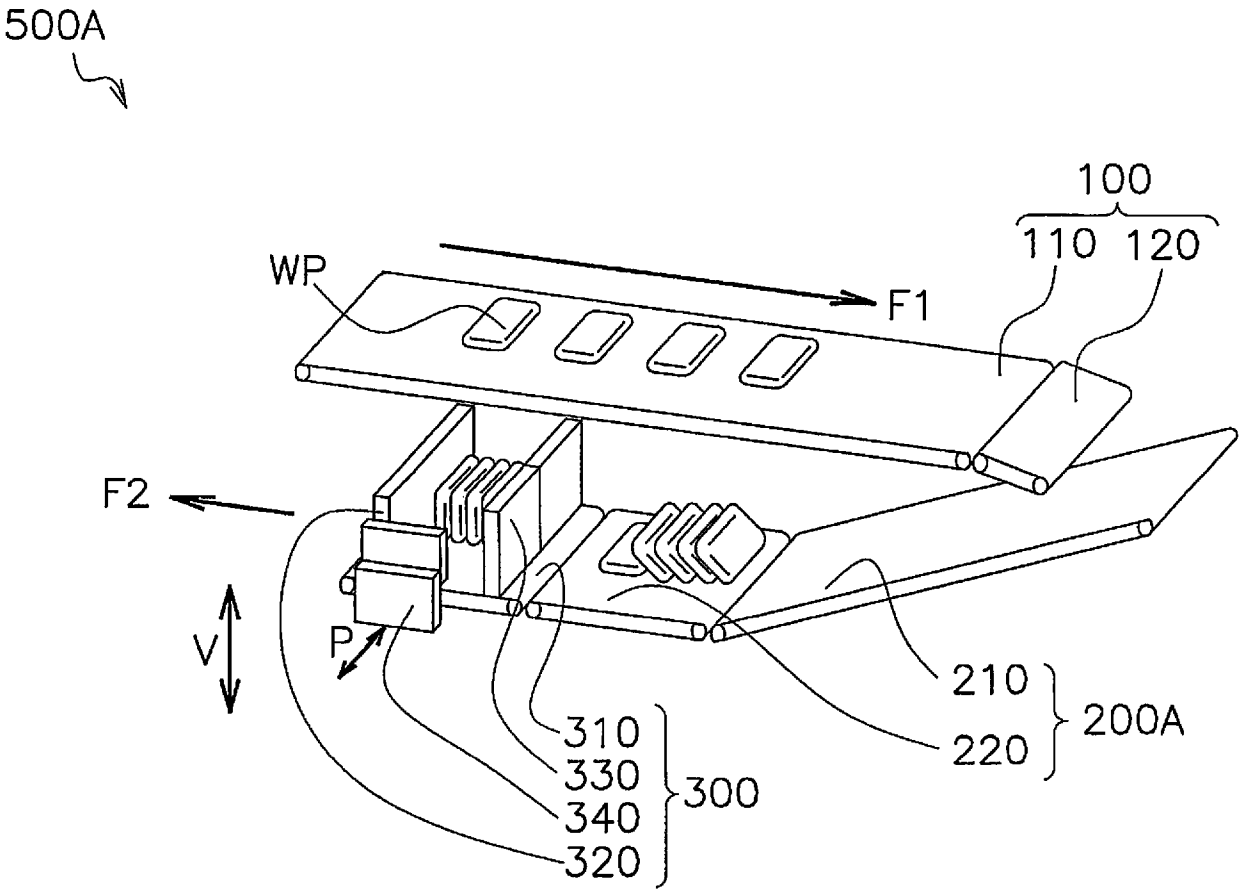
FIG. 1 is a perspective view of a configuration of a box packing device according to a first embodiment of the present invention.

FIG. 1 illustrates a configuration of a box packing device 500A according to a first embodiment of the present invention. The box packing device 500A receives articles WP wrapped in bags from a wrapping device one at a time and packs a predetermined number of the articles WP into a box.

The box packing device 500A is provided with a feed mechanism 100, an accumulating mechanism 200A, and a push-in mechanism 300.

(2) Detailed Configurations

(2-1) Feed Mechanism 100

The feed mechanism 100 receives the articles WP wrapped in bags one at a time from an unillustrated wrapping device installed in the previous stage of the box packing device 500A, feeds the articles WP in a feeding direction F1, and passes the articles WP on to the accumulating mechanism 200A.

The feed mechanism 100 has a feed conveyor belt 110 and a discharge conveyor belt 120. The discharge conveyor belt 120 is disposed in an inclined manner.

(2-2) Accumulating Mechanism 200A

The accumulating mechanism 200A accumulates a predetermined number of the articles WP. The accumulating mechanism 200A has a first conveyor belt 210 and a second conveyor belt 220. The first conveyor belt 210 is inclined with respect to the horizontal direction and forms a sloped surface. The first conveyor belt 210 constantly operates.

The second conveyor belt 220 is stopped or operates at a low speed until the predetermined number of the articles WP are accumulated. As a result, a plurality of the articles WP fed sequentially from the feed mechanism 100 are accumulated on the second conveyor belt 220 in a partially overlapped manner.

When the predetermined number of the articles WP are accumulated, the second conveyor belt 220 operates at a high speed and passes the group of the articles WP on to the push-in mechanism 300.

(2-3) Push-In Mechanism 300

The push-in mechanism 300 receives the predetermined number of articles WP accumulated by the accumulating mechanism 200A, aligns the articles WP and packs the articles WP into a box.

Figure 2:
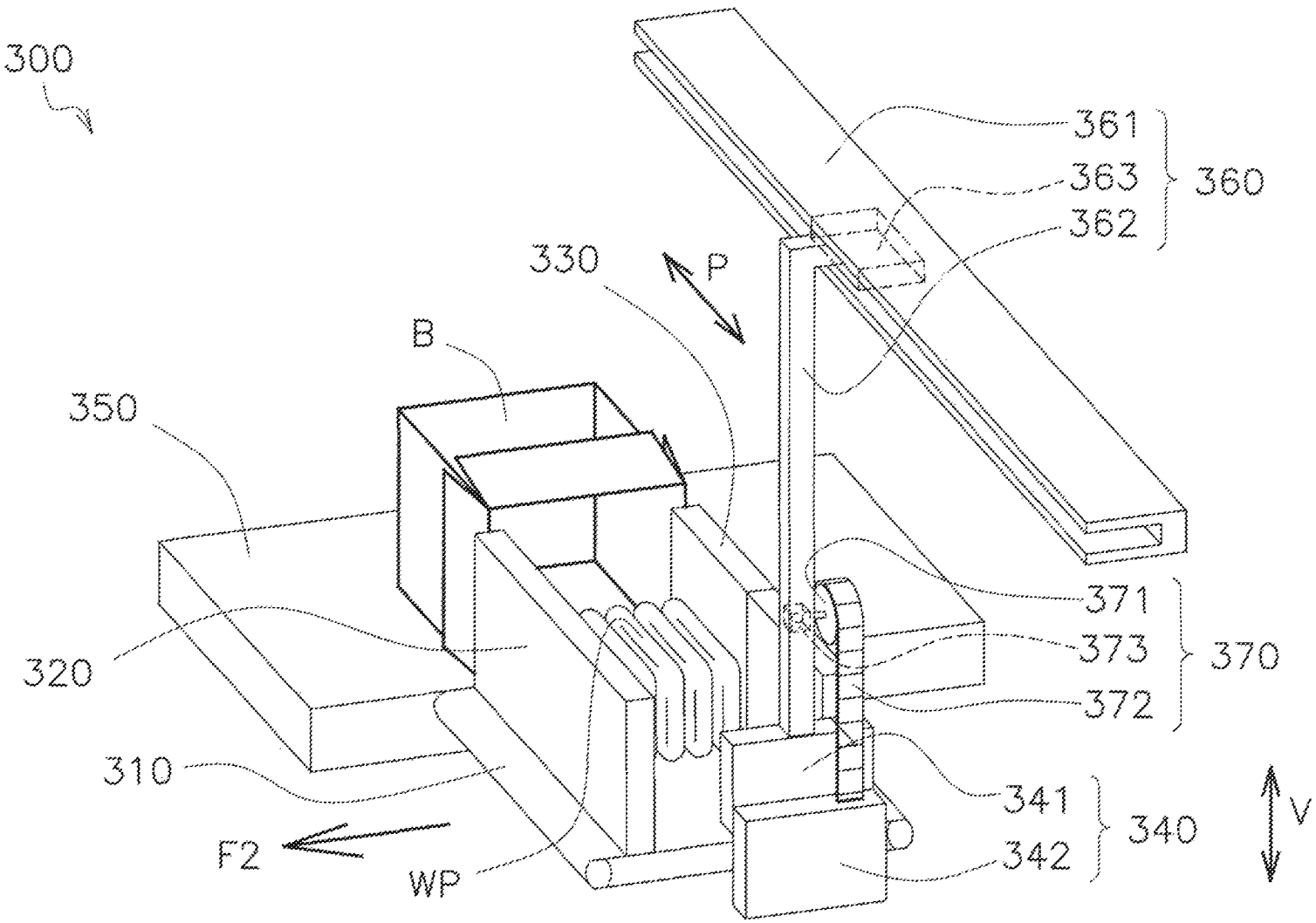
FIG. 2 is a perspective view of a configuration of a push-in mechanism mounted in the box packing device illustrated in FIG. 1.

FIG. 2 illustrates a configuration of the push-in mechanism 300. The push-in mechanism 300 has an article placement part 310, a stopper 320, a support plate 330, a push-in plate 340, a box standby part 350, a horizontal movement mechanism 360, and a lifting/lowering mechanism 370.

(2-3-1) Article Placement Part 310

The article placement part 310 is for placing one group of the articles WP to be boxed. The article placement part 310 includes a conveyor belt and is able to feed the articles WP in a feeding direction F2.

Figure 3:
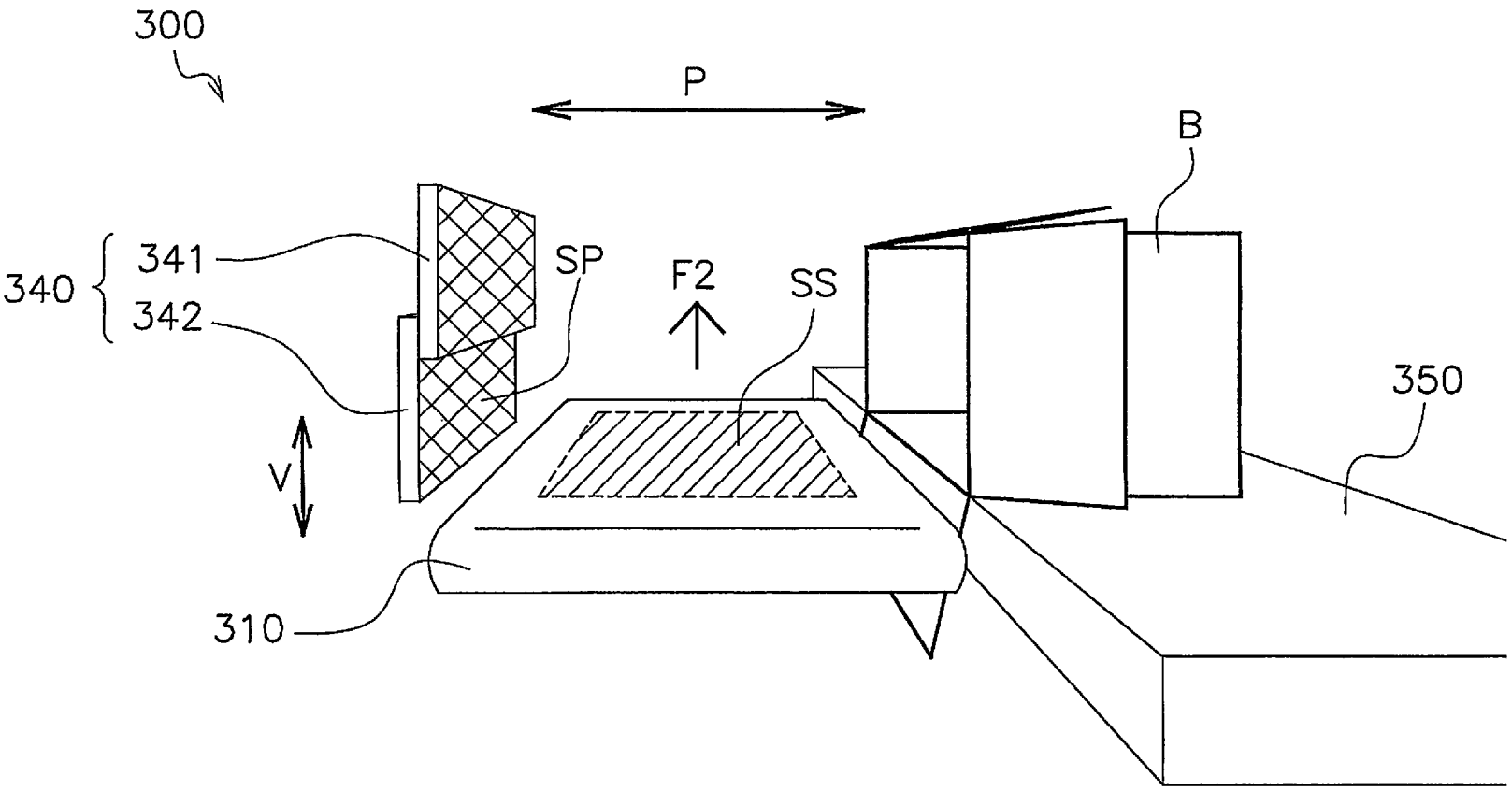
FIG. 3 is a view of the push-in mechanism illustrated in FIG. 2 as seen from the side.

As illustrated in FIG. 3, the upper surface of the article placement part 310 constitutes a placement surface SS regardless of the rotation state of the conveyor belt, and the article placement part 310 feeds one group of the articles WP received from the accumulating mechanism 200A to the placement surface SS.

(2-3-2) Stopper 320 and Support Plate 330

Returning to FIG. 2, the stopper 320 is a plate for blocking the movement of the front end of a group of the articles WP. The support plate 330 is a plate for supporting the rear end of a group of the articles WP after the group of the articles WP is received by the push-in mechanism 300. The stopper 320 and the support plate 330 are able to move appropriately for capturing and aligning a group of the articles WP.

(2-3-3) Push-In Plate 340

The push-in plate 340 is able to move or reciprocate in a reciprocating direction P due to the horizontal movement mechanism 360. The push-in plate 340 has a first plate 341 and a second plate 342. The first plate 341 is fixed to the horizontal movement mechanism 360. The second plate 342 is able to move relative to the first plate in a vertical direction V.

As illustrated in FIG. 3, the push-in plate 340 has a pressing surface SP, which is able to push a group of the articles WP. At least the second plate 342 has the pressing surface SP. The push-in plate 340 packs a group of the articles WP into a box B by moving closer to the box B.

(2-3-4) Box Standby Part 350

Returning to FIG. 2, the box B opened at the side is placed on the box standby part 350. The box standby part 350 has a lifting/lowering mechanism 351 and has an upper surface 352 that is flat. The lifting/lowing mechanism 351 is also referred to as a height adjusting mechanism 351. The lifting/lowing mechanism 351 is operated so as to allow for lifting and lowering of the box B when located on the upper surface 352. With the box B on the upper surface 352, the lifting/lowering mechanism 351 moves the box B into position such that a group of the articles WP are packed therein in a subsequent process and further movement of the upper surface 352 brings a new empty box B to the place where subsequent packing will be performed.

(2-3-5) Horizontal Movement Mechanism 360

The horizontal movement mechanism 360 moves the push-in plate 340 in the reciprocating direction P. The horizontal movement mechanism 360 has a beam 361 and a fixing member 362. The first plate 341 of the push-in plate 340 is fixed to the fixing member 362, The fixing member 362 is moved in the reciprocating direction P along the beam 361 by, drive mechanism 363.

The lifting/lowering mechanism 370 lifts and lowers the second plate 342 by moving the second plate 342 relative to the first plate 341 in the vertical direction V. The lifting/lowering mechanism 370 has a roller 371 and a belt 372. The roller 371 is fixed to the fixing member 362 in a rotatable manner and is rotated by a motor 373. The belt 372 has one end fixed to the roller 371 and the other end fixed to the second plate. Due to the force of the motor, the roller 371 winds the belt 372 up or returns the belt 372 whereby the second plate 342 is lifted or lowered.

(3) Actions

Figure 4A:
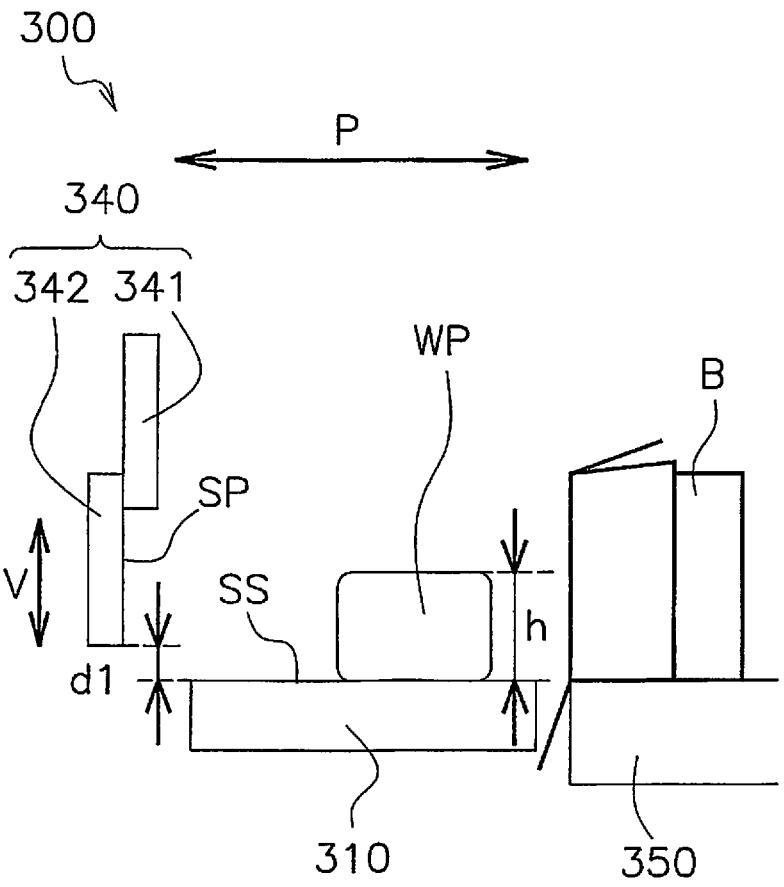
FIG. 4A is a view of a first step of a push-in action performed by the push-in mechanism illustrated in FIG. 2.
Figure 4B:
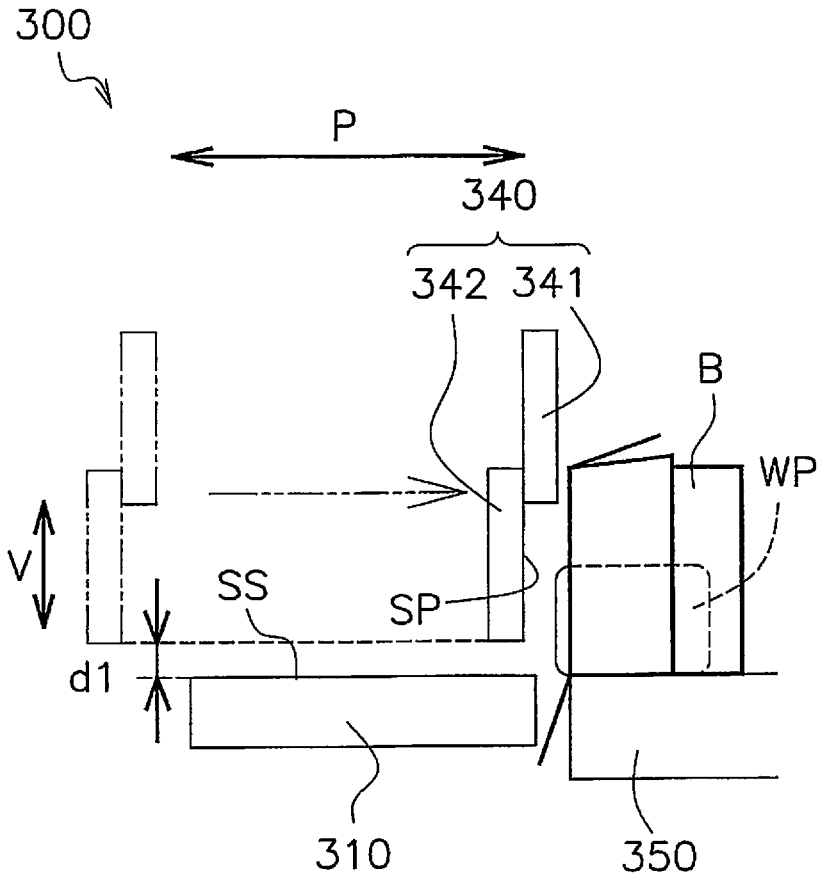
FIG. 4B is a view of a second step of the push-in action performed by the push-in mechanism illustrated in FIG. 2.
Figure 4C:
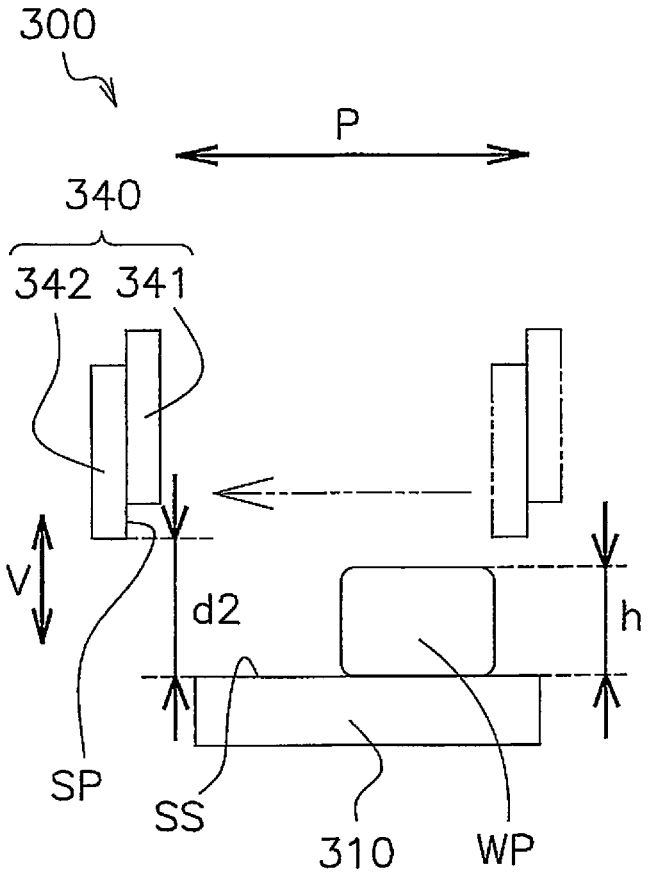
FIG. 4C is a view of a third step of the push-in action performed by the push-in mechanism illustrated in FIG. 2.

FIG. 4A to 4C illustrate push-in actions executed by the push-in mechanism 300.

(3-1) First Step

FIG. 4A illustrates the first step of the push-in action.

In this step, a group of the articles WP that has come from the accumulating mechanism 200A (FIG. 1) is placed on the placement surface SS of the article placement part 310. At this time, the second plate 342 is lowered. As a result, the height of the placement surface SS and the height of the lower edge of the pressing surface SP are separated from each other by a first distance d1.

(3-2) Second Step

FIG. 4B illustrates the second step of the push-in action.

In this step, the push-in plate 340 moves toward the box B and consequently the pressing surface SP pushes the group of the articles WP toward the box B. As a result, the group of the articles WP is packed into the box B. The separation distance between the height of the placement surface SS and the height of the lower edge of the pressing surface SP is maintained at the first distance d1.

(3-3) Third Step

FIG. 4C illustrates the third step of the push-in action.

In this step, the push-in plate 340 returns to the location of the first step. At this time, the second plate 342 is lifted upward. As a result, the separation distance between the height of the placement surface SS and the height of the lower edge of the pressing surface SP becomes a second distance d2 which is greater than the first distance d1. As a result, the next group of the articles WP to be boxed can be placed on the placement surface SS without being hindered by the push-in plate 340. Thereafter, the push-in action returns to the first step.

(4) Characteristics 4-1

The lifting/lowering mechanism 370 in the push-in mechanism 300 is able to move the push-in plate 340 so that the distance separating the lower edge of the pressing surface SP and the placement surface SS in the vertical direction changes. Therefore, after the push-in action of the push-in plate 340 pushing the articles into the box B is finished, hindering of the movement of the next articles WP to be pushed into the box can be suppressed by increasing the height of the lower edge of the pressing surface SP.

4-2

In the orientation shown in FIG. 4B, the first plate 341 is installed in an upright state and the second plate 342 is also installed in an upright state closer to the placement surface SS than the first plate 341. The pressing surface SP is present at least on the second plate 342. The second plate 342 is moved in the vertical direction V by the lifting/lowering mechanism 370. Therefore, because the dimension in the vertical direction V of the push-in plate 340 can be extended and reduced, the push-in mechanism 300 is able to handle articles WP of various sizes.

4-3

The lifting/lowering mechanism 370 sets the separation distance to the first distance d1 when the horizontal movement mechanism 360 moves the push-in plate 340 toward the box B. The lifting/lowering mechanism 370 sets the separation distance to the second distance d2, which is greater than the first distance d1, when the horizontal movement mechanism 360 moves the push-in plate 340 away from the box B. Therefore, the movement of the next articles WP to be pushed into the same box B or a different new box B can be performed during the return action of the push-in plate 340, and consequently the speed of the push-in action can be improved.

4-4

The box packing device 500A is provided with the push-in mechanism 300 having a fast processing speed. Therefore, the processing speed of the box packing device 500A is improved.

(5) Modified Examples (5-1) First Modified Example 1A

The push-in mechanism 300 mounted in the box packing device 500A according to a first modified example 1A of the first embodiment changes the action of the lifting/lowering mechanism 370 according to the size of the article WP.

The box packing device 500A according to the first modified example 1A is further provided with a detection means, which is not illustrated, for detecting the size of the article WP, specifically, the height h of the article WP. The box packing device 500A determines, on the basis of a signal from the detection means, whether the height h of the article WP is greater than the second distance d2 explained in FIG. 4C.

If the height h of the article WP is less than the second distance d2, the push-in mechanism 300 according to the modified example 1A performs the push-in action including the steps illustrated in FIG. 4A to 4C in the same way as the push-in mechanism 300 according to the first embodiment.

Figure 5A:
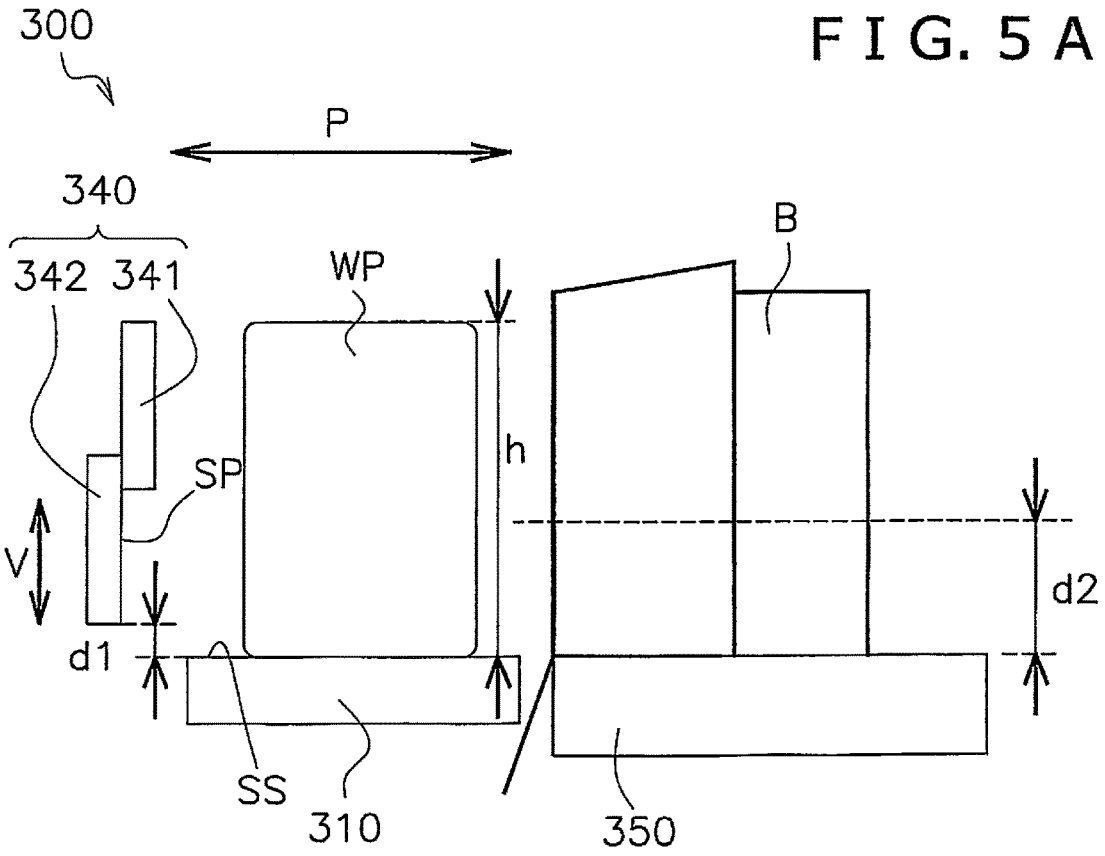
FIG. 5A is a view of a first step of a push-in action performed by a push-in mechanism mounted in the box packing device according to a first modified example 1A of the first embodiment of the present invention.
Figure 5B:
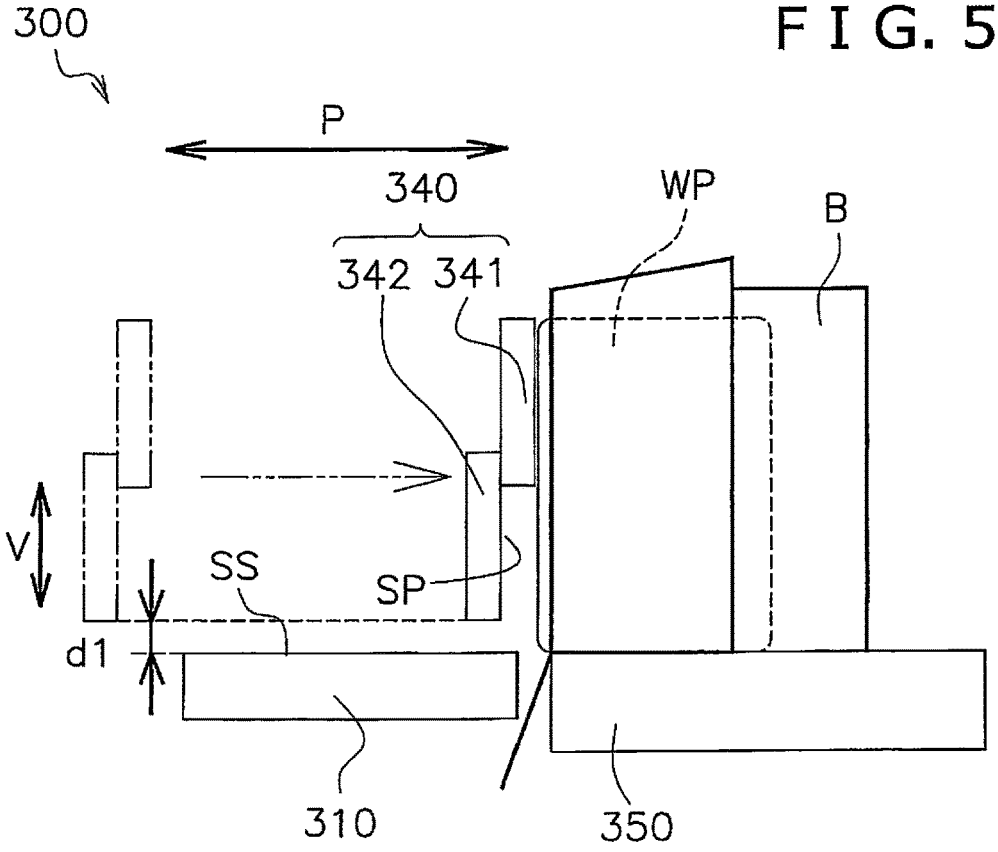
FIG. 5B is a view of a second step of the push-in action performed by the push-in mechanism mounted in the box packing device according to the first modified example 1A of the first embodiment of the present invention.

On the other hand, if the height h of the article WP is equal to or greater than the second distance d2, the push-in mechanism 300 according to the modified example 1A performs a push-in action including a first step in FIG. 5A and then a second step in FIG. 5B.

In the first step illustrated in FIG. 5A, the second plate 342 is lowered and the height of the placement surface SS and the height of the lower edge of the pressing surface SP are separated from each other by the first distance d1.

In the second step illustrated in FIG. 5B, the push-in plate 340 approaches the box B and consequently the pressing surface SP pushes the group of the articles WP toward the box B. The first plate 341 contributes to the action of pushing the article WP. At this time, the height of the placement surface SS and the height of the lower edge of the pressing surface SP are still separated from each other by the first distance d1.

Next, without the lifting and lowering of the second plate being performed, the push-in plate 340 is returned to the disposition in FIG. 5A. Thereafter, the next group of the articles WP to be boxed arrives at the placement surface SS, and then the first step is executed again.

According to this configuration, the first plate 341 as well as the second plate 342 contribute to the action of pushing the article WP and therefore the article WP having the large height h can be packed into the box B in a stable manner.

(5-2) Second Modified Example 1B

The push-in mechanism 300 mounted in the box packing device 500A according to a second modified example 1B of the first embodiment extends and retracts the width of the push-in plate 340 according to the size of the article WP.

Figure 6:
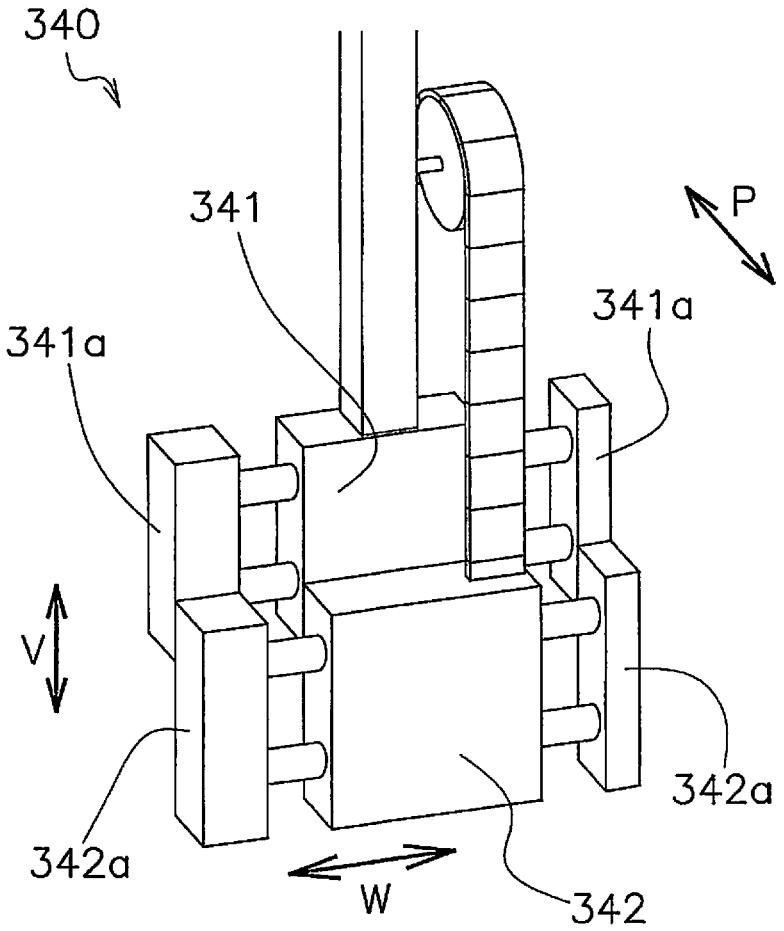
FIG. 6 is a perspective view of a push-in plate mounted in the box packing device according to a second modified example 1B of the first embodiment of the present invention.

FIG. 6 illustrates a configuration of the push-in plate 340 according to the second modified example 1B. The push-in plate 340 has a first plate 341 and a second plate 342. The first plate 341 has a first plate extension part 341*a* that allows for extension and retraction in the width direction W. The second plate 342 similarly has a second plate extension part 342*a* that allows for extension and retraction in the width direction W. The width direction W is a direction perpendicular to both the reciprocating direction P and the vertical direction V of the push-in plate 340. The extension and retraction is carried out automatically by an extending mechanism which is not illustrated.

Furthermore, the box packing device 500A according to the second modified example 1B is further provided with a detecting means, which is not illustrated, for detecting the size of the article WP, specifically, the dimension in the feeding direction F2 (FIG. 2), namely, the dimension in the width direction W of the article WP.

According to this configuration, the width of the push-in plate 340 can be increased due to the extension of the first plate extension part 341*a* and the second plate extension part 342*a* when handling the article WP having a dimension equal to or greater than a predetermined value. Therefore, the push-in action of a large article WP can be performed in a stable manner.

(5-3) Third Modified Example 1C

The push-in mechanism 300 mounted in the box packing device 500A according to a third modified example 1C of the first embodiment also extends and retracts the width of the push-in plate 340 according to the size of the article WP.

Figure 7A:
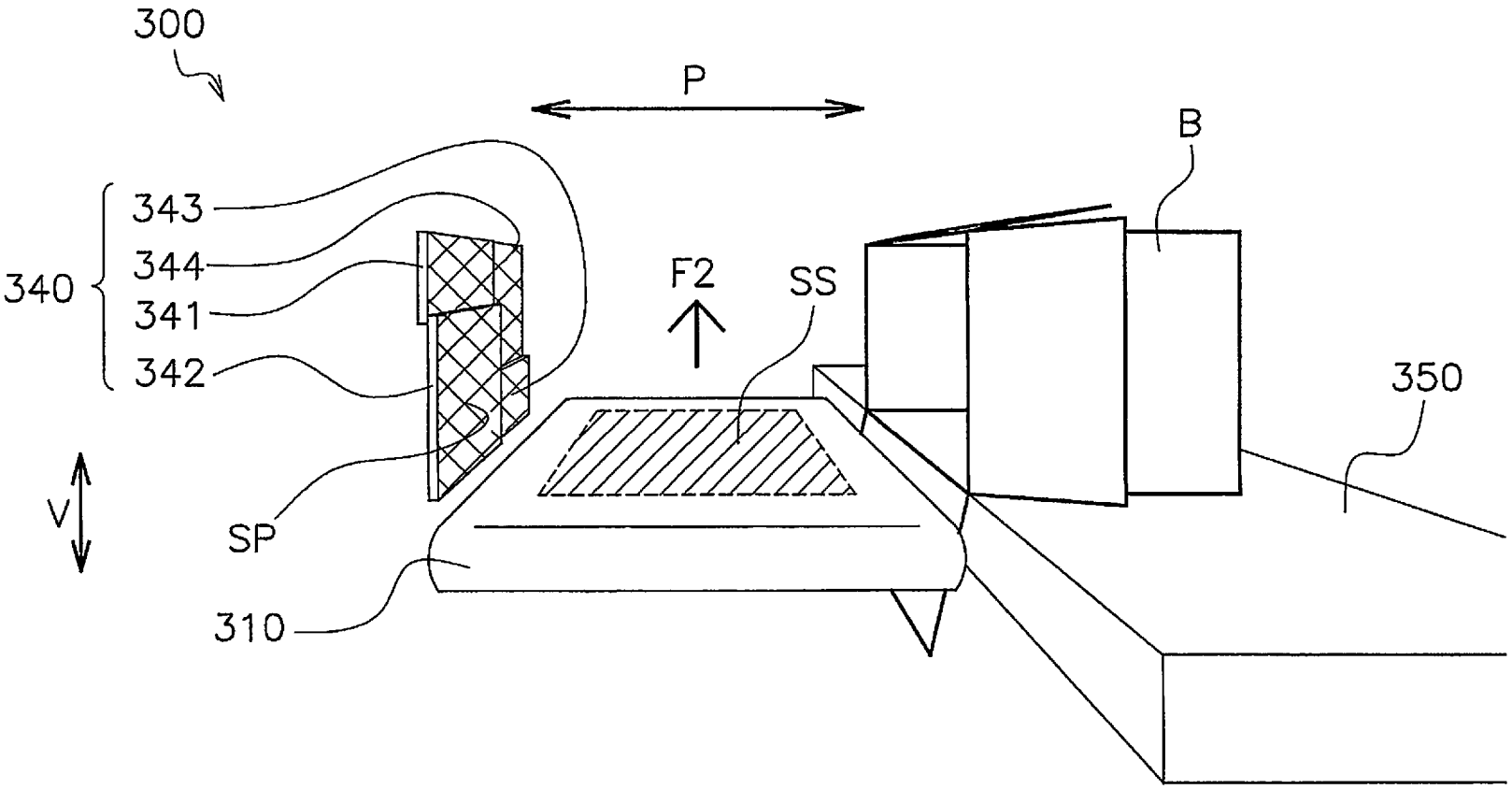
FIG. 7A is a view as seen from the side of a push-in mechanism mounted in the box packing device according to a third modified example 1C of the first embodiment of the present invention.

FIG. 7A illustrates the push-in mechanism 300 according to the third modified example 1C. The push-in plate 340 of the push-in mechanism 300 has a third plate 343 and a fourth plate 344 in addition to the first plate 341 and the second plate 342, and, as a result, differs from the first embodiment and the first modified example 1A and the second modified example 1B thereof. At least the second plate 342 among the first plate 341, the second plate 342, the third plate 343, and the fourth plate 344 has the pressing surface SP.

Figure 7B:
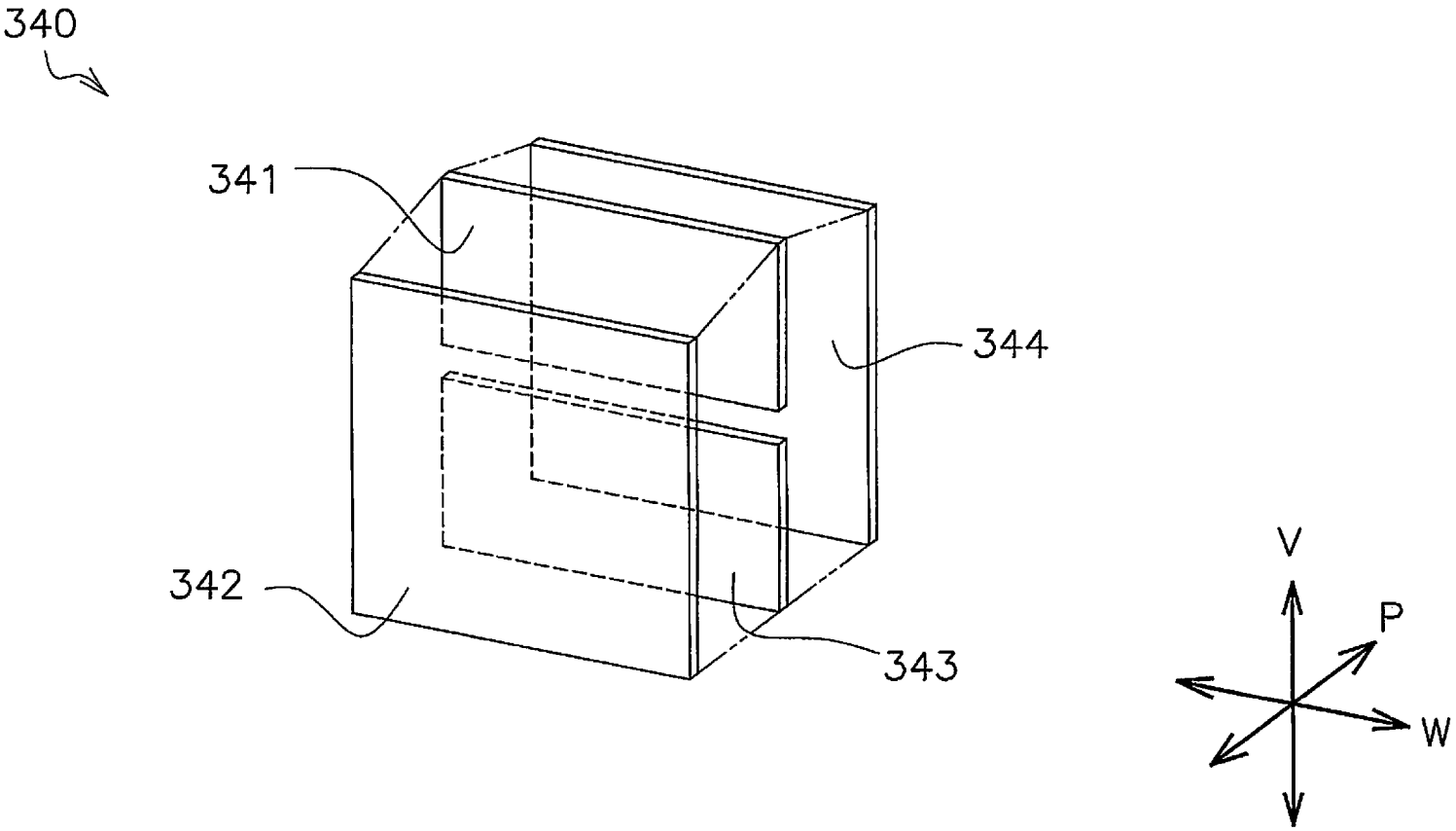
FIG. 7B is an oblique exploded view illustrating a push-in plate mounted in the box packing device according to the third modified example 1C of the first embodiment of the present invention.

FIGS. 7B to 7E illustrate a configuration of the push-in plate 340 according to the third modified example 1C. As illustrated in FIG. 7B, the push-in plate 340 has a three-layer structure. The first layer includes the second plate 342. The second layer includes the first plate 341 and the third plate 343. The third layer includes the fourth plate 344. The first plate 341 is fixed to the horizontal movement mechanism 360, which is not illustrated in FIG. 7B, in the same way the explained above with regard to the first embodiment, and the first modified example 1A and the second modified example 1B thereof.

Figure 7C:
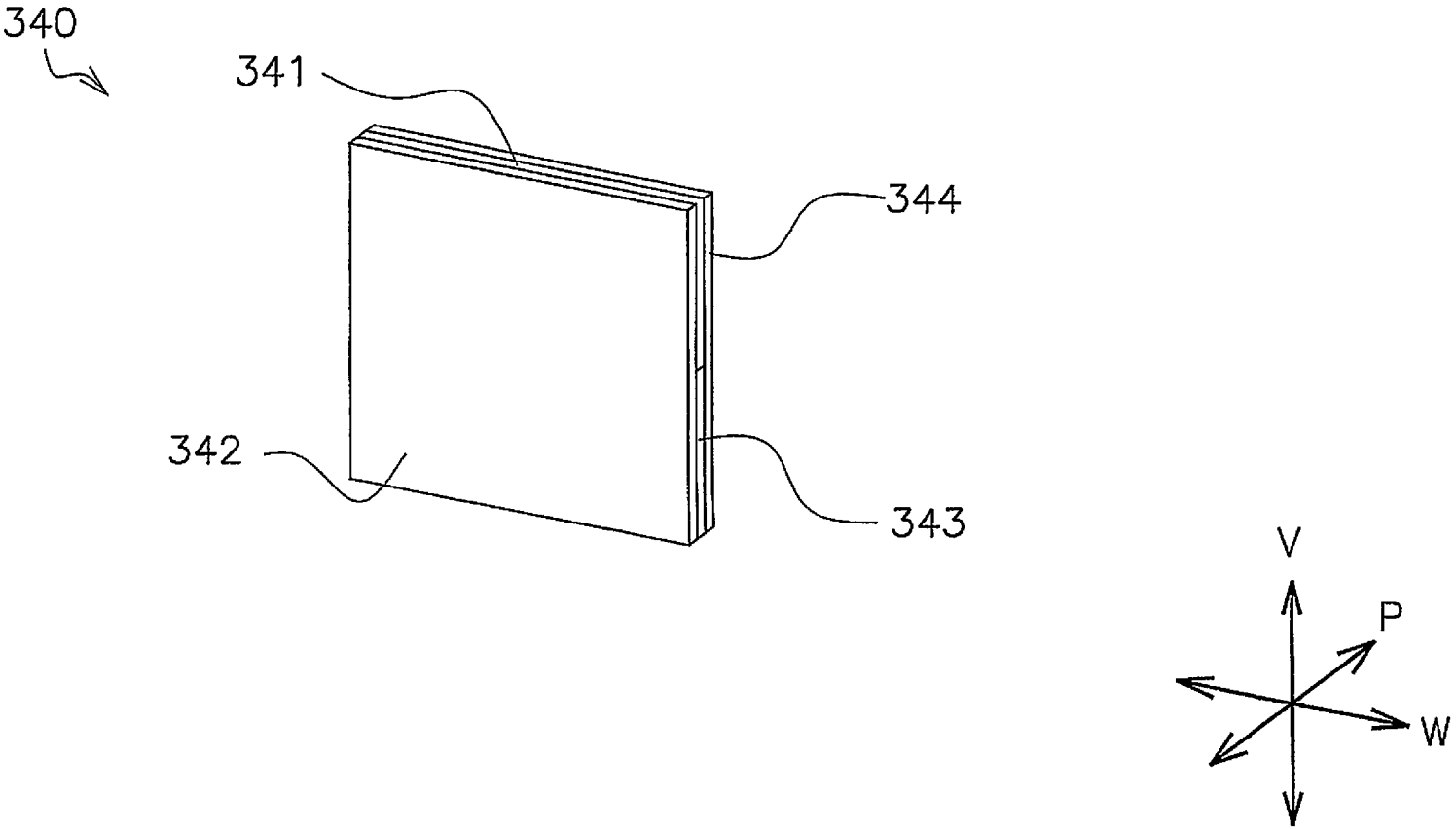
FIG. 7C is a perspective view of the push-in plate mounted in the box packing device according to the third modified example 1C of the first embodiment of the present invention.

FIG. 7C illustrates the push-in plate 340 while the second plate 342 is lifted upward so as to approach the first plate 341. This form corresponds to the third step of the push-in action explained with reference to FIG. 4C.

Figure 7D:
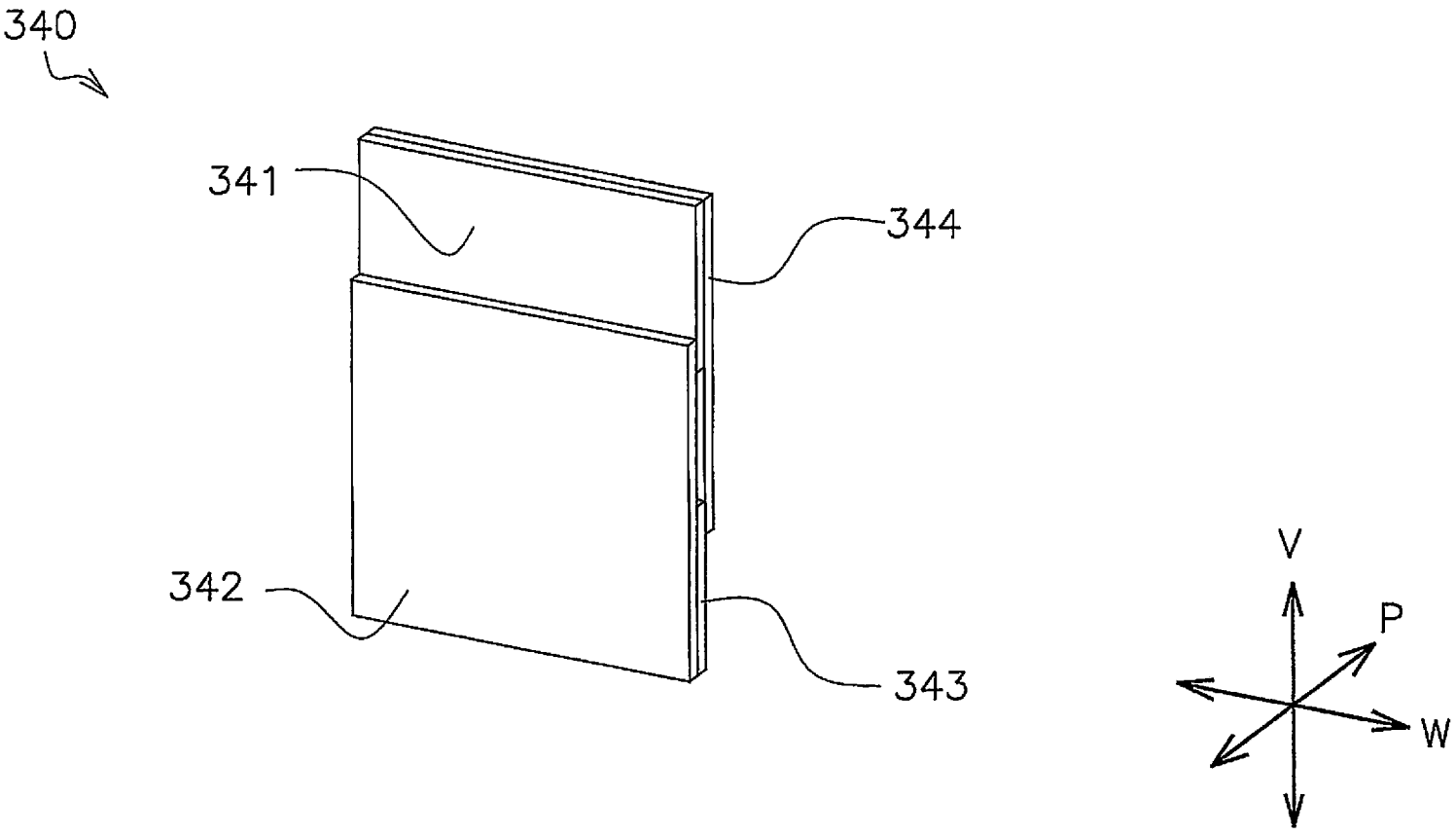
FIG. 7D is perspective view of the push-in plate mounted in the box packing device according to the third modified example 1C of the first embodiment of the present invention.

FIG. 7D illustrates the push-in plate 340 while the second plate 342 is lowered so as to approach the placement surface SS (FIG. 7A). This form corresponds to the first step and the second step of the push-in action explained with reference to FIGS. 4A and 4B. At this time, the third plate 343 is also lowered with the second plate 342.

Figure 7E:
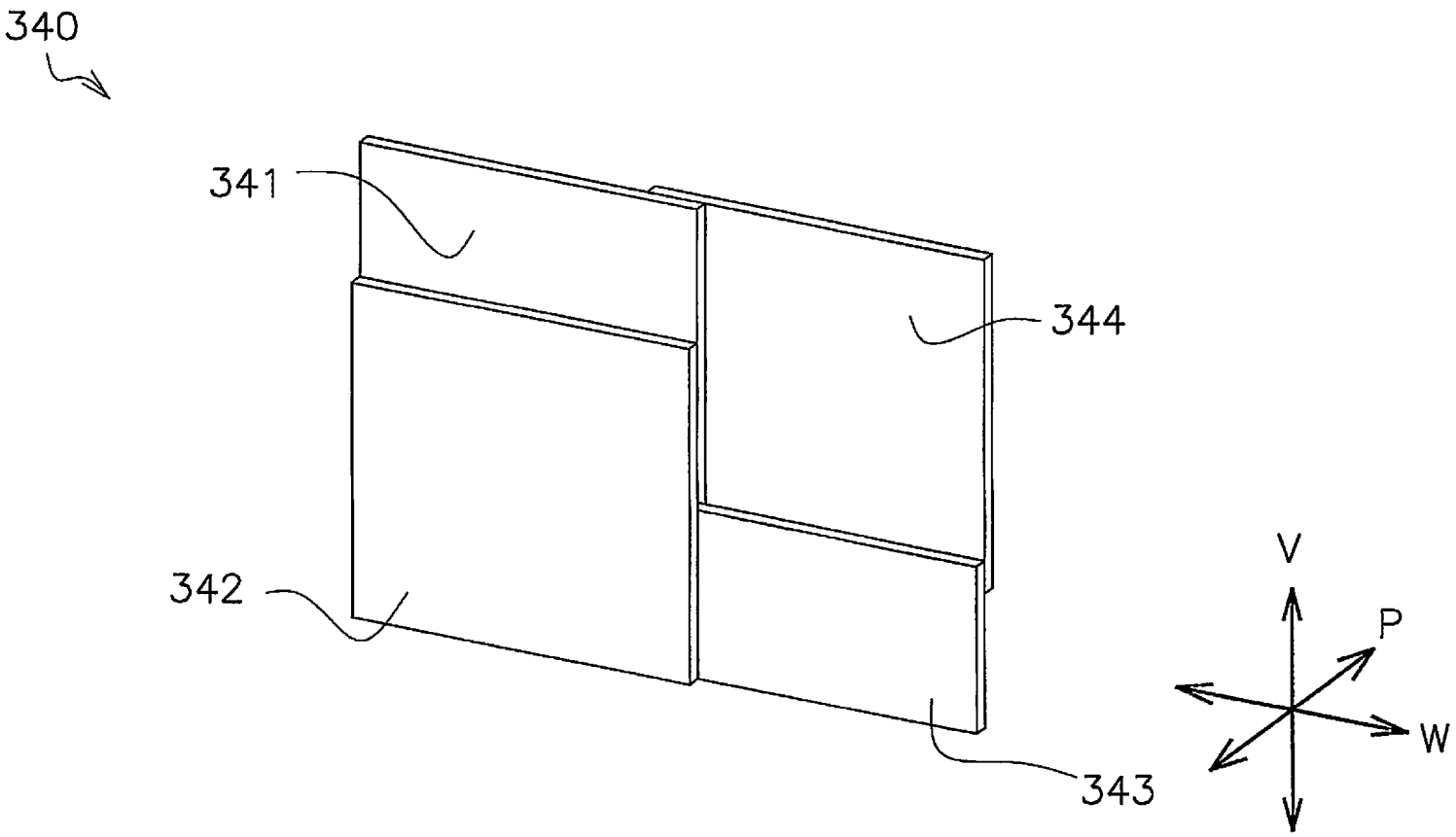
FIG. 7E is a perspective view of the push-in plate mounted in the box packing device according to the third modified example 1C of the first embodiment of the present invention.

FIG. 7E illustrates the push-in plate 340 that has been extended further in the width direction W. In comparison to the state illustrated in FIG. 7D, the third plate 343 and the fourth plate 344 are moved relative to the first plate 341 and the second plate 342. The first plate 341 and the third plate 343 that similarly configure the second layer are present on the same plane.

The push-in mechanism 300 mounted in the box packing device 500A according to the third modified example 1C of the first embodiment does not have the lifting/lowering mechanism 370 of the first embodiment, and in place thereof, has an extension mechanism, which is not illustrated, for changing the form of the push-in plate 340 as illustrated in FIGS. 7C to 7E.

The first plate 341, the second plate 342, the third plate 343, and the fourth plate 344 are configured by thin plates having a thickness, for example, of 1.5 mm or less. Therefore, the step between the second plate 342 and the fourth plate 344 is a small dimension of 3.0 mm or less in the extended push-in plate 340 illustrated in FIG. 7E.

As illustrated in FIG. 7A, when the push-in plate 340 pushes the article WP toward the box B, the push-in plate 340 is able to push the article WP with a uniform force because the step between the first plate 341, the second plate 342, the third plate 343, and the fourth plate 344 is small. Therefore, the push-in action can be performed in a stable manner.

Second Embodiment

Overall Configuration

Figure 8:
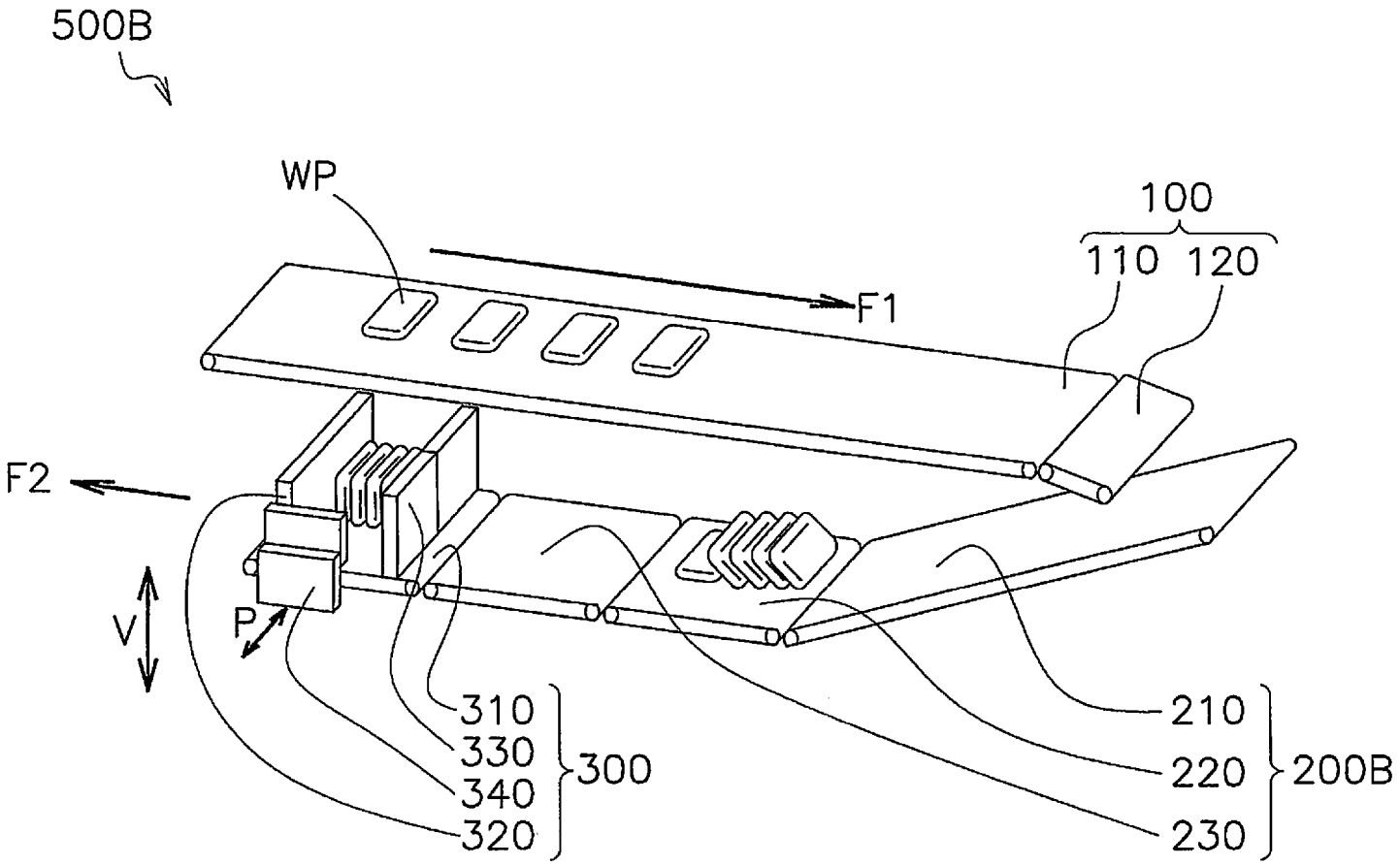
FIG. 8 is a perspective view of a configuration of a box packing device according to a second embodiment of the present invention.

FIG. 8 illustrates a configuration of a box packing device 500B according to a second embodiment of the present invention. An accumulating mechanism 200B having a different configuration is mounted in the box packing device 500B of the second embodiment in place of the accumulating mechanism 200A mounted in the box packing device 500A according to the first embodiment or the modified examples thereof. The box packing device 500B of the second embodiment is the same as the box packing device 500A according to the first embodiment in the other aspects.

(2) Detailed Configuration

The accumulating mechanism 200B differs from the accumulating mechanism 200A according to the first embodiment in that the accumulating mechanism 200B has a third conveyor belt 230 in addition to the first conveyor belt 210 and the second conveyor belt 220.

The first conveyor belt 210 is inclined with respect to the horizontal direction and forms a sloped surface. The first conveyor belt 210 constantly operates.

The second conveyor belt 220 is stopped or operates at a low speed until the predetermined number of the articles WP are accumulated. As a result, a plurality of the articles WP fed sequentially from the feed mechanism 100 are accumulated on the second conveyor belt 220 in a partially overlapping manner.

When the predetermined number of the articles WP are accumulated, the second conveyor belt 220 operates at a high speed and passes the group of the articles WP on to the third conveyor belt 230.

The third conveyor belt 230 operates when predetermined conditions, such as the state of the subsequent push-in mechanism 300 and the like, are satisfied, and passes the group of the articles WP on to the push-in mechanism 300.

According to this configuration, the third conveyor belt 230 functions as a buffer. When the push-in mechanism 300 is carrying out an action, the third conveyor belt 230 is not able to pass the group of the articles WP on to the push-in mechanism 300 and therefore holds the group of the articles WP. During that time, the accumulating mechanism 200B is able to execute the accumulation action by using the first conveyor belt 210 and the second conveyor belt 220. Therefore, the utilization rate of the accumulating mechanism 200B is improved and the accumulating mechanism 200B can avoid becoming a bottleneck in the production line.

(3) Modified Example

The configurations of the push-in mechanism 300 according to the first modified example 1A, the second modified example 1B, and the third modified example 1C of the first embodiment may be integrated with the box packing device 500B according to the second embodiment.

The invention claimed is:

1. A push-in mechanism for pushing articles into a box that is opened sideways, the push-in mechanism comprising:

a box standby part that includes a flat surface temporarily supporting the box until the box is moved downstream;

an article placement part having a placement surface on which the articles are temporarily placed, the article placement part being configured to retain the articles prior to being put in the box;

a push-in plate installed in a standing state so as to have a pressing surface, the push-in plate being configured to push the articles from the placement surface toward the box, the push-in plate having a first plate extending in a vertical direction, and a second plate extending in a vertical direction and defining the pressing surface, the second plate being closer to the placement surface than the first plate after being moved toward the box;

a horizontal movement mechanism having a beam, a fixing member and a drive mechanism configured to reciprocatingly move the push-in plate horizontally above the placement surface so that the push-in plate moves toward the box in a push-in direction or moves away from the box, the first plate and the second plate being parallel and adjacent to one another; and a lifting/lowering mechanism including a motor for moving the push-in plate so as to change a separation distance in the vertical direction between a lower edge of the pressing surface and the placement surface, the lifting/lowering mechanism being configured to move the second plate in the vertical direction relative to the first plate to change the separation distance with the second plate remaining parallel to the first plate during vertical direction movement, wherein, the articles are put on the placement surface with movement in a feeding direction and the horizontal movement mechanism moves the push-in plate and the articles from the placement surface toward the box in the push-in direction, the feeding direction being perpendicular to the push-in direction and the push-in direction being parallel with the placement surface.

2. The push-in mechanism according to claim 1, wherein:

the lifting/lowering mechanism sets the separation distance to a first distance when the horizontal movement mechanism moves the push-in plate toward the box, the lifting/lowering mechanism sets the separation distance to a second distance when the horizontal movement mechanism moves the push-in plate away from the box, and the second distance is greater than the first distance.

3. The push-in mechanism according to claim 1, wherein:

the lifting/lowering mechanism sets the separation distance to a first distance when the horizontal movement mechanism moves the push-in plate toward the box, the lifting/lowering mechanism sets the separation distance to a second distance when the horizontal movement mechanism moves the push-in plate away from the box, and the second distance is greater than the first distance when the size of the article is smaller than a predetermined size, and the second distance is equal to the first distance when the size of the article is greater than the predetermined size.

4. The push-in mechanism according to claim 1, wherein:

the push-in plate is capable of extending and retracting in a width direction perpendicular to a reciprocating direction and a height direction of the push-in plate.

5. A box packing device comprising:

a feed mechanism including a feed conveyor belt for feeding the articles in order one at a time;

an accumulating mechanism including an accumulating conveyor belt for accumulating a predetermined number of the articles; and the push-in mechanism according to claim 1 for pushing the predetermined number of the articles into the box.

6. The box packing device according to claim 5, wherein:

the accumulating mechanism has a first conveyor belt disposed in an inclined manner for receiving the articles from the feed mechanism, a second conveyor belt for forming an article group including the predetermined number of the articles, and a third conveyor belt for receiving the article group from the second conveyor belt and being capable of temporarily holding the article group, and the article placement part has a placement conveyor belt for receiving the article group from the third conveyor belt and moving the article group to the placement surface.

7. The box packing device according to claim 6, wherein:

the lifting/lowering mechanism sets the separation distance to a first distance when the horizontal movement mechanism moves the push-in plate toward the box, the lifting/lowering mechanism sets the separation distance to a second distance when the horizontal movement mechanism moves the push-in plate away from the box, and the second distance is greater than the first distance.

8. The box packing device according to claim 6, wherein:

the lifting/lowering mechanism sets the separation distance to a first distance when the horizontal movement mechanism moves the push-in plate toward the box, the lifting/lowering mechanism sets the separation distance to a second distance when the horizontal movement mechanism moves the push-in plate away from the box, and the second distance is greater than the first distance when the size of the article is smaller than a predetermined size, and the second distance is equal to the first distance when the size of the article is greater than the predetermined size.

* * * * *